US009817359B2

(12) United States Patent
Kadowaki

(10) Patent No.: US 9,817,359 B2
(45) Date of Patent: Nov. 14, 2017

(54) WASTE TONER DETECTION MECHANISM AND IMAGE FORMING APPARATUS

(71) Applicant: Sharp Kabushiki Kaisha, Osaka (JP)

(72) Inventor: Hideaki Kadowaki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/285,571

(22) Filed: Oct. 5, 2016

(65) Prior Publication Data

US 2017/0102665 A1 Apr. 13, 2017

(30) Foreign Application Priority Data

Oct. 9, 2015 (JP) ..... 2015-201366

(51) Int. Cl.
*G03G 21/12* (2006.01)
*G03G 21/10* (2006.01)

(52) U.S. Cl.
CPC ..... *G03G 21/12* (2013.01); *G03G 21/105* (2013.01); *G03G 2215/0132* (2013.01)

(58) Field of Classification Search
CPC ..... G03G 21/12; G03G 15/553
USPC ..... 399/35, 60
See application file for complete search history.

(56) References Cited

U.S. PATENT DOCUMENTS

2005/0254833 A1* 11/2005 Yokoe ..... G03G 15/0863 399/12
2006/0039710 A1* 2/2006 Tawada ..... G03G 21/105 399/35
2010/0098442 A1* 4/2010 Lee ..... G03G 15/553 399/35
2011/0243585 A1* 10/2011 Mizutani ..... G03G 15/0856 399/35

FOREIGN PATENT DOCUMENTS

JP 09-237020 A 9/1997

* cited by examiner

*Primary Examiner* — Sandra Brase
(74) *Attorney, Agent, or Firm* — Renner Otto Boisselle & Sklar, LLP

(57) ABSTRACT

A waste toner detection mechanism includes a transmission member and a flag member. The transmission member transmits the rotation of a rotation transmission member to a stirring shaft. The transmission member can move between the farthest position and the closest position to the rotation transmission member in the axial direction of the stirring shaft and moves from the farthest position to the closest position with an increase in difference in rotation between the rotation transmission member and the stirring shaft. The transmission member has a locking portion elastically engaged with the rotation transmission member in the closest position and restricts movement of the transmission member to the farthest position. The flag member moves from a retracting position of being stored in the waste toner container to an exposing position of being exposed from the waste toner container with the transmission member moving from the farthest position to the closest position.

6 Claims, 4 Drawing Sheets

WASTE TONER DETECTION MECHANISM AND IMAGE FORMING APPARATUS

CROSS REFERENCE

This Nonprovisional application claims priority under 35 U.S.C. §119(a) on Patent Application No. 2015-201366 filed in Japan on Oct. 9, 2015, the entire contents of which are hereby incorporated by reference.

BACKGROUND OF THE INVENTION

The present invention relates to a waste toner detection mechanism that detects a state in which waste toner has been full in a waste toner container provided in an image forming apparatus, and an image forming apparatus provided with such a waste toner detection mechanism.

When a toner image is formed with toner on a photoreceptor in an electrophotographic image forming process in an image forming apparatus, all the toner is not transferred onto a paper sheet, and toner that has not been transferred remains as waste toner on the photoreceptor. The waste toner is scraped from the photoreceptor and sent to a waste toner container before the following charging process. The image forming apparatus is provided with a waste toner detection mechanism that detects a state in which waste toner has been full in the waste toner container and prompts disposal of the waste toner or replacement of the waste toner container when the waste toner detection mechanism detects a full state of the waste toner.

Some conventional waste toner detection mechanisms have been provided with a floating member that rotates with an increase of the storage amount of waste toner in the waste toner container, a cam member that rotates along with the floating member, and a flag member that is biased upward by a spring (see Japanese Patent Laid-Open Publication No. H09-237020, for example).

According to the waste toner detection mechanism disclosed in Japanese Patent Laid-Open Publication No. H09-237020, the cam member is provided with a slit on the peripheral surface of the cam member, and the flag member is provided with a protruding portion that contacts the peripheral surface of the cam member. The cam member rotates along with floating member with the increase in the storage amount of the waste toner. When the cam member rotates to a position in which the slit faces the protruding portion, the flag member rises by the elastic force of the spring, the protruding portion then fits into the slit, and the light shielding portion of the flag member is exposed and displays the full state of the waste toner. By the elastic force of the spring that acts on the flag member, the light shielding portion continues to display the full state. Since the full state of the waste toner is held on the side of the waste toner container, it is not necessary to store the full state of waste toner on the side of the main body of the image forming apparatus, and thus the load on a control portion is reduced.

However, the waste toner detection mechanism disclosed in Japanese Patent Laid-Open Publication No. H09-237020 needs to be provided with the floating member that rotates with the increase in the waste toner in the waste toner container, which causes a problem that the size of the waste toner container is increased. In addition, since the height of the waste toner in the waste toner container is not uniform, the floating member is capable of only partially detecting the height of the waste toner but is not capable of accurately detecting the collected amount of the waste toner of the entire waste toner container, which easily causes an error in detecting the full state. Further, the waste toner detection mechanism disclosed in Japanese Patent Laid-Open Publication No. H09-237020 maintains the display of the full state by the light shielding portion of the flag member by using the elastic force of the spring, which makes it difficult to cope with large torque that acts on the stirring shaft of a large-capacity toner collection container. In addition, the waste toner detection mechanism disclosed in Japanese Patent Laid-Open Publication No. H09-237020 is not capable of easily releasing the display of the full state by the light shielding portion of the flag member and therefore is not suitable for reuse of the waste toner container.

In view of the foregoing, preferred embodiments of the present invention are directed to provide a waste toner detection mechanism and an image forming apparatus that are capable of accurately detecting the full state of waste toner based on torque that acts on a stirring shaft and achieving the reuse of a waste toner container without incurring the increase in size of the waste toner container.

SUMMARY OF THE INVENTION

A waste toner detection mechanism according to preferred embodiments of the present invention is provided in a waste toner container provided with a rotation transmission member and a stirring shaft to which rotation is transmitted through the rotation transmission member. The waste toner detection mechanism is provided with a transmission member and a flag member. The transmission member is configured to transmit the rotation of the rotation transmission member to the stirring shaft. The transmission member is capable of moving between the farthest position in which the transmission member is located farthest from the rotation transmission member in the axial direction of the stirring shaft and the closest position in which the transmission member is located closest to the rotation transmission member in the axial direction of the stirring shaft and moves from the farthest position to the closest position with an increase in difference in rotation between the rotation transmission member and the stirring shaft. In addition, the transmission member has a locking portion that is elastically engaged with the rotation transmission member in the closest position and restricts the transmission member from moving to the farthest position. The flag member moves from a retracting position in which the flag member is stored in the waste toner container to an exposing position in which the flag member is exposed from the waste toner container along with the transmission member moving from the farthest position to the closest position.

The foregoing and other features and attendant advantages of the present invention will become more apparent from the reading of the following detailed description of the preferred embodiments with reference to the attached drawings.

DETAILED DESCRIPTION OF THE EMBODIMENTS

Figure 1:
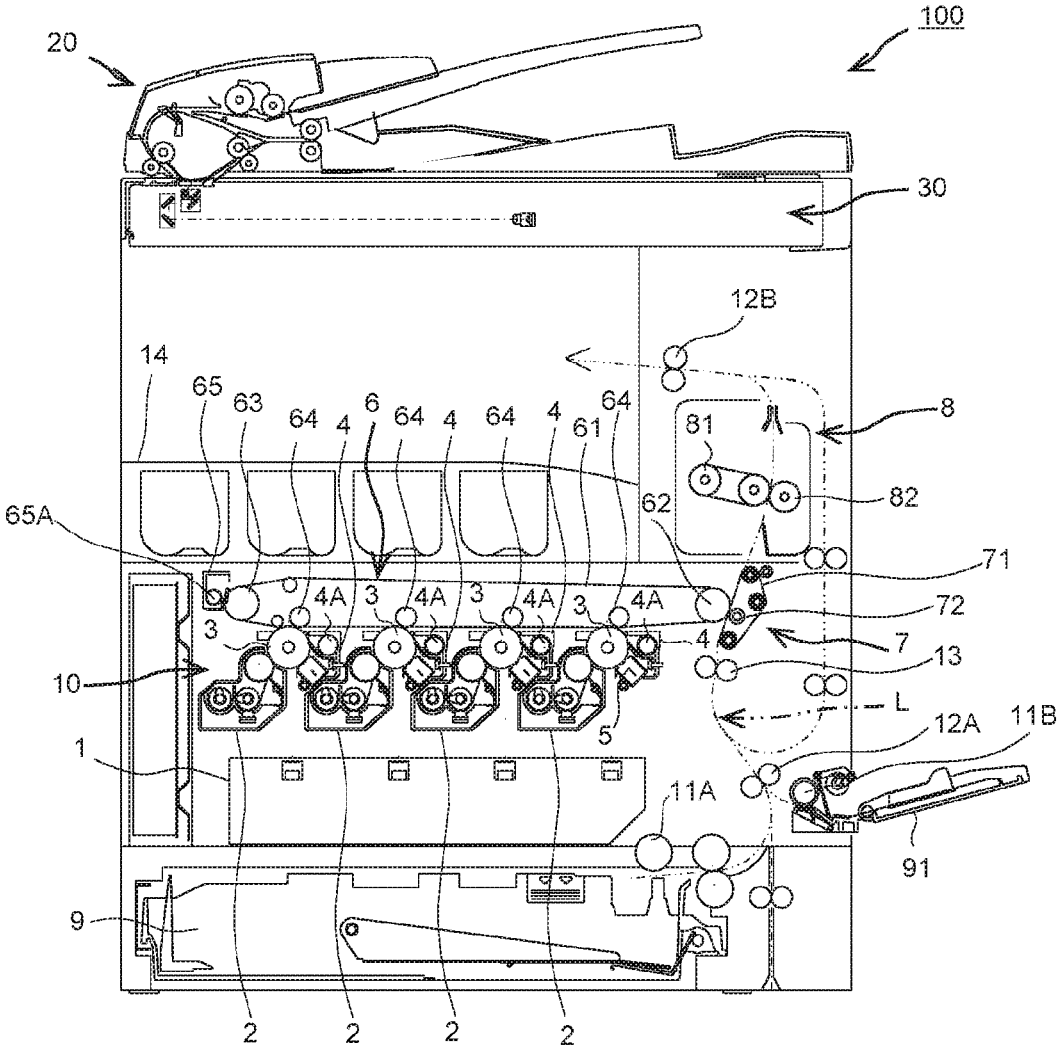
FIG. 1 is a front sectional view schematically illustrating a configuration of an image forming apparatus provided with a waste toner detection mechanism according to a preferred embodiment of the present invention.

As illustrated in FIG. 1, an image forming apparatus 100 is provided with an image forming portion 10, an automatic document reading portion 20, and a document reading portion 30, and performs multicolor and single color image forming processes on a paper sheet according to image data. Although not illustrated in FIG. 1, a waste toner container provided with a waste toner detection mechanism according to preferred embodiments of the present invention is attached on a front side of the image forming portion 10.

The image forming portion 10 has an exposure unit 1, a developing device 2, a photoreceptor drum 3, a cleaner 4, a charging device 5, an intermediate transfer belt unit 6, a secondary transfer belt unit 7, a fixing unit 8, a paper feed cassette 9, a paper output tray 14, and the like. The image forming portion 10 performs an image forming process on a paper sheet.

The developing device 2, the photoreceptor drum 3, the charging device 5, and the cleaner 4 are arranged in each of four image stations corresponding to color images in black (K), cyan (C), magenta (M), and yellow (Y). In each station, four kinds of latent images corresponding to the respective colors are formed.

The cleaner 4 is provided with a conveying screw (not illustrated) that discharges toner, and a pipe 4A in which the conveying screw is arranged, collects the waste toner that has remained on the peripheral surface of the photoreceptor drum 3, and discharges the waste toner via the pipe 4A.

The charging device 5 is a charger type that uniformly charges the surface of the photoreceptor drum 3 to a predetermined potential.

The exposure unit 1 is a laser scanning unit (LSU) provided with a laser emitting portion, a reflecting mirror, and the like. The exposure unit 1 exposes the photoreceptor drum 3 with laser light in accordance with inputted image data and then forms an electrostatic latent image in accordance with the inputted image data on the surface of the photoreceptor drum 3. The developing device 2 visualizes the electrostatic latent image formed on the photoreceptor drum 3 with toner in four colors (YMCK).

The intermediate transfer belt unit 6 is arranged above the photoreceptor drum 3 and has an intermediate transfer belt 61, an intermediate transfer belt driving roller 62, an intermediate transfer belt driven roller 63, an intermediate transfer roller 64, and an intermediate transfer belt cleaning unit 65. Four intermediate transfer rollers 64 are provided corresponding to the respective colors of YMCK. The intermediate transfer belt cleaning unit 65 is provided with a pipe 65A in which the conveying screw that discharges waste toner is arranged, and the waste toner that has been removed from the intermediate transfer belt 61 is discharged to the waste toner container 300 (see FIG. 2) via the pipe 65A.

The paper feed cassette 9 stores a stack of paper sheets to be used for image forming and is provided below the exposure unit 1 of the image forming portion 10. The paper sheets to be used for image forming may be placed on a manual paper feed tray 91 as well. The paper output tray 14 provided above the image forming portion 10 stores a paper sheet upon which the image forming process has been performed in the image forming portion 10.

The secondary transfer belt unit 7 is provided with a secondary transfer belt 71 and a secondary transfer roller 72. The secondary transfer roller 72 is pressed against the intermediate transfer belt driving roller 62 across the secondary transfer belt 71 and the intermediate transfer belt 61 at a predetermined nip pressure.

The image forming portion 10 is provided with a paper sheet feed path L along which the paper sheet in the paper feed cassette 9 or the manual paper feed tray 91 is fed to the paper output tray 14 via the secondary transfer roller 72 and the fixing unit 8. The paper sheet feed path L is a conveying path leading from the paper feed cassette 9 or the manual paper feed tray 91 to the paper output tray 14. Along the paper sheet feed path L, pickup rollers 11A and 11B, a pair of feed rollers 12A, a pair of registration rollers 13, the secondary transfer roller 72, the fixing unit 8, and a pair of feed rollers 12B are arranged in this order from the upstream side to the downstream side.

The pickup roller 11A is provided in the vicinity of the end portion of the paper feed cassette 9, picks up the paper sheets one by one from the paper feed cassette 9, and supplies the paper sheet to the paper sheet feed path L. The pickup roller 11B is provided in the vicinity of the end portion of the manual paper feed tray 91, picks up the paper sheets one by one from the manual paper feed tray 91, and supplies the paper sheet to the paper sheet feed path L.

The pair of registration rollers 13 temporarily holds the paper sheet that is being fed along the paper sheet feed path L.

The pair of registration rollers 13 feeds the paper sheet to a pair of rollers consisting of the intermediate transfer belt driving roller 62 and the secondary transfer roller 72 through the intermediate transfer belt 61 on the downstream side with a timing when the tip of the toner image on the photoreceptor drum 3 and the tip of the paper sheet are aligned.

The pair of rollers consisting of the intermediate transfer belt driving roller 62 and the secondary transfer roller 72 through the intermediate transfer belt 61 is a pair of rollers that feeds the paper sheet while nipping the paper sheet between the rollers and transfers the toner image born on the intermediate transfer belt 61 onto the printing surface of the paper sheet.

The fixing unit 8 is arranged above the secondary transfer belt unit 7 and is provided with a fixing roller 81 and a pressurizing roller 82. The fixing unit 8, by rotating while nipping the paper sheet between the fixing roller 81 and the pressurizing roller 82, heats and pressurizes the paper sheet, and fixes the toner image on the paper sheet.

Figure 2:
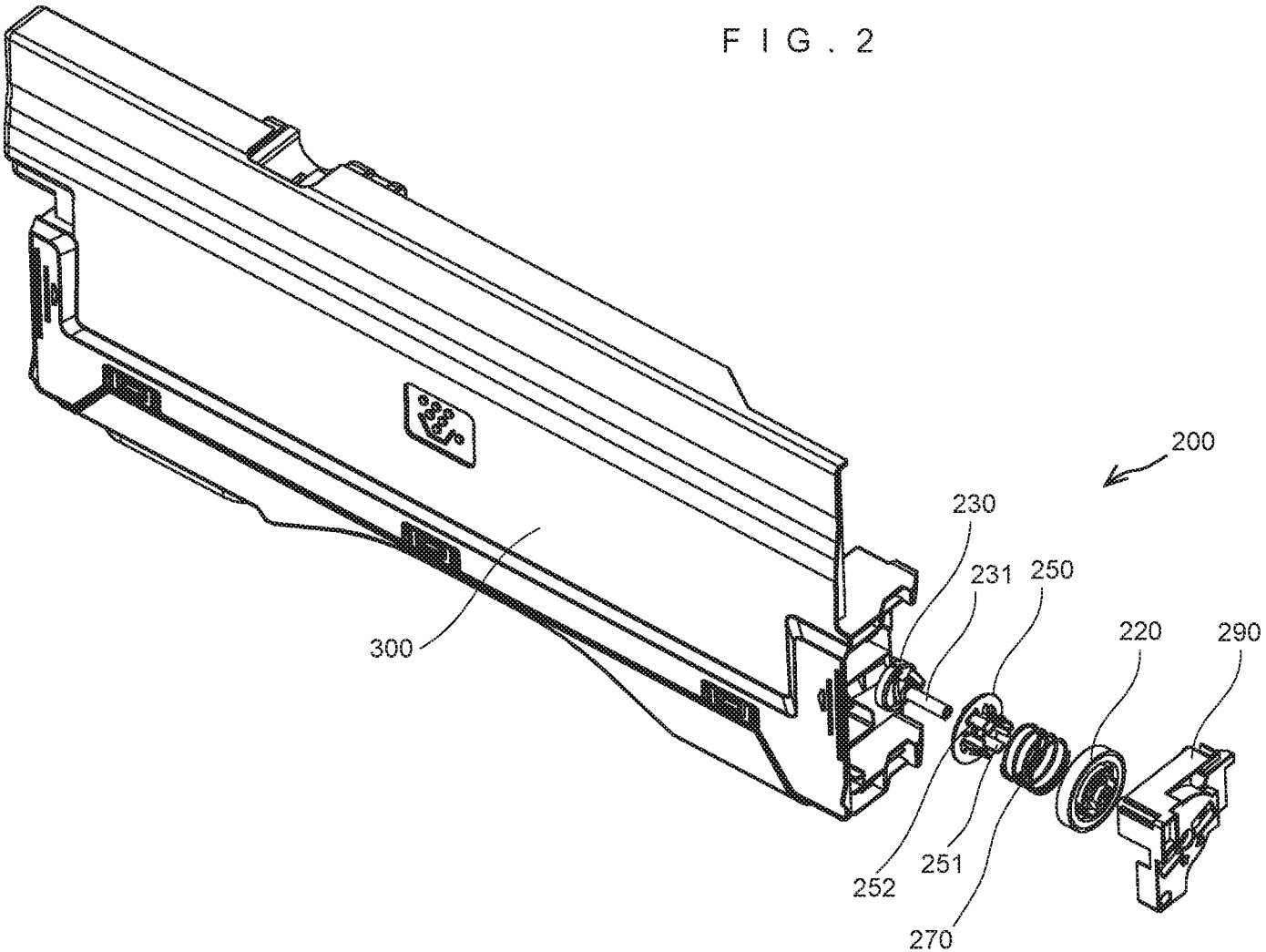
FIG. 2 is an exploded perspective view of a waste toner container provided with the waste toner detection mechanism.
Figure 3A:
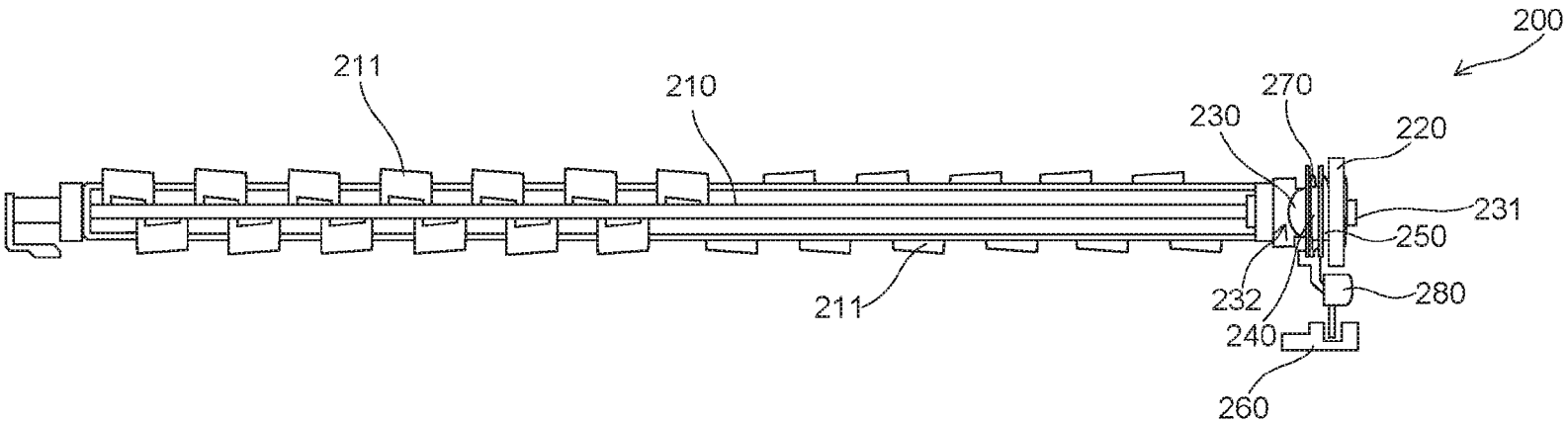
FIG. 3A is a front view of a main part of the waste toner detection mechanism and FIG. 3B is an expanded perspective view of the main part of the waste toner detection mechanism.
Figure 3B:
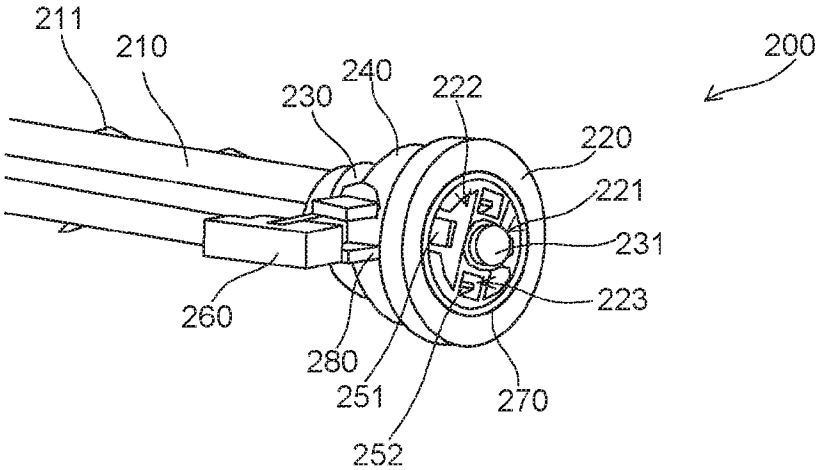
Figure 4B:
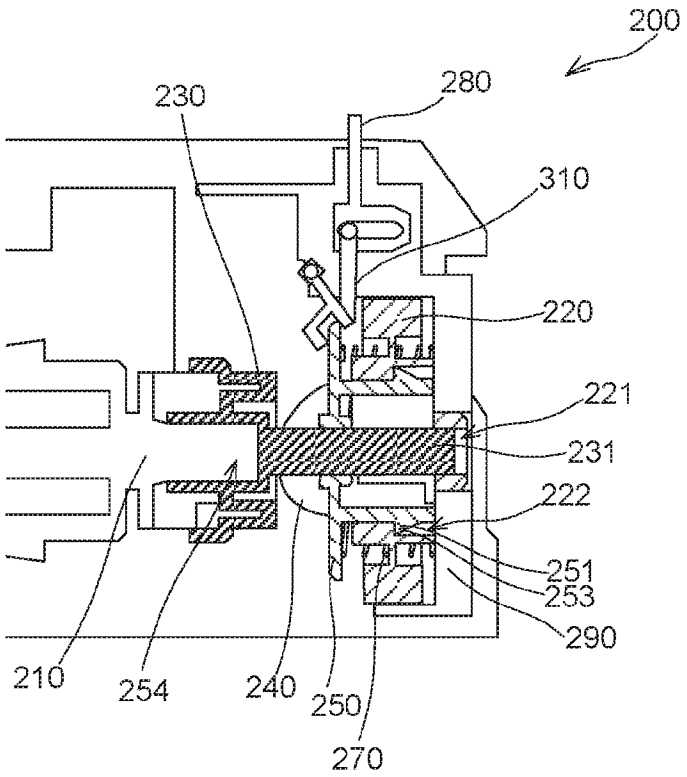
FIG. 4A and FIG. 4B are front sectional views respectively illustrating a not-full state and a full state of waste toner in the waste toner detection mechanism.
Figure 4A:
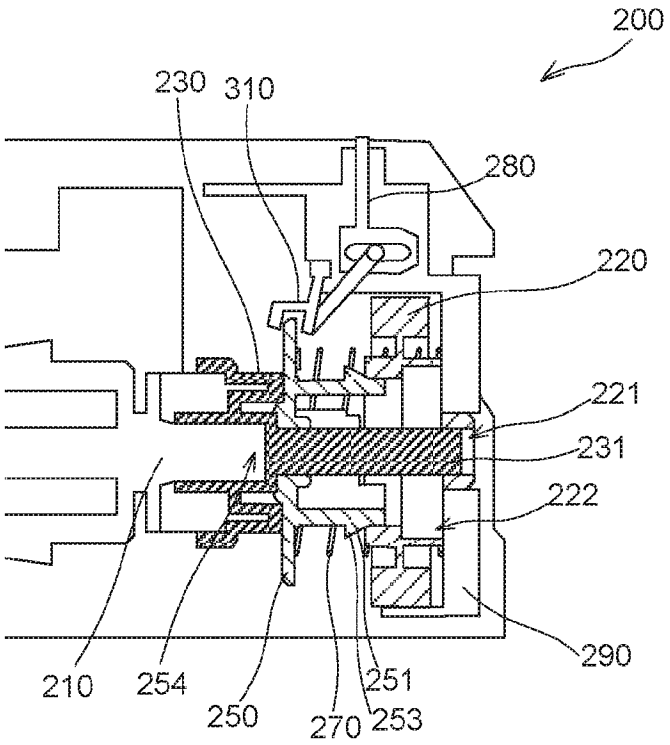

As illustrated in FIG. 2, a waste toner detection mechanism 200 according to a preferred embodiment of the present invention is attached to the outside of one side of a waste toner container 300. As illustrated in FIG. 2, FIG. 3A, and FIG. 3B, the waste toner detection mechanism 200 is provided with a stirring shaft 210, a driven gear 220, a first cam 230, a second cam 240, a transmission member 250, a sensor 260, a biasing member 270, and a flag member 280. The waste toner detection mechanism 200 is further provided with a coupling member 310 as illustrated in FIG. 4A and FIG. 4B.

As illustrated in FIG. 3A, the stirring shaft 210 is a shaft having a length that is equal or substantially equal to the substantially entire area in the longitudinal direction of the inside of the waste toner container 300, and is provided with a plurality of stirring members 211 protruded from the peripheral surface, and is rotatably supported in the waste toner container 300 while the position in the axial direction is fixed. When the stirring shaft 210 rotates, the stirring member 211 contacts the waste toner stored in the waste toner container 300 and planarizes the surface of the waste toner. Accordingly, the waste toner is stored uniformly in the entire area in the waste toner container 300.

As illustrated in FIG. 2 and FIG. 3A, the driven gear 220 is equivalent to a rotation transmission member defined by the present invention and rotates engaging with a not-illustrated driving gear coupled with the rotating shaft of a motor provided in the image forming apparatus 100. As illustrated in FIG. 3B, the driven gear 220 is centrally provided with a cylindrical boss portion 221. As illustrated in FIG. 4A and FIG. 4B, the driven gear 220 is rotatably supported in a state in which the position in the axial direction is fixed by a cover 290 that is attached to the side surface of the waste toner container 300 and configures a part of the waste toner container 300.

As illustrated in FIG. 3A and FIG. 3B, the first cam 230 is equivalent to an inclined cam of the present invention, may preferably be arranged between the stirring shaft 210 and the driven gear 220 in the axial direction of the stirring shaft 210, and may preferably be centrally provided with a recessed portion 232 and a shaft portion 231. The recessed portion 232 has the shape of a cylinder open on the side of the stirring shaft 210 and is fitted into by the cylindrical end portion of the stirring shaft 210. The shaft portion 231 extends to the side of the driven gear 220 and fits into the boss portion 221. The stirring shaft 210, the first cam 230, and the driven gear 220 are arranged coaxially to one another.

The transmission member 250 is disc-shaped and is arranged between the first cam 230 and the driven gear 220 in the axial direction of the stirring shaft 210. The transmission member 250 may preferably be provided with the second cam 240 that is equivalent to a cam follower of the present invention and is protruded from the side surface on the side of the first cam 230. The transmission member 250, on the side surface on the side of the driven gear 220, may preferably be provided with two locking portions 251 and two engaging portions 252 that extend in the axial direction. In addition, the transmission member 250 is centrally provided with the boss portion 254 fitted around the outside of the shaft portion 231. The boss portion 254 is fitted around the outside of the shaft portion 231 and slides, and therefore the transmission member 250 becomes movable in the axial direction.

The second cam 240 may be an inclined cam provided with the inclined surface that contacts the inclined surface of the first cam 230. The locking portions 251 and the engaging portions 252 are each fitted into the first hole portion 222 and the second hole portion 223 of the driven gear 220, respectively. As illustrated in FIG. 4A and FIG. 4B, each of the locking portions 251 is provided with a wedge-shaped projection 253 projected radially on the open end of the locking portion 251.

In the circumferential direction of the driven gear 220, the width of the second hole portion 223 is made equal to the width of the engaging portion 252, the engaging portion 252 is inserted into the second hole portion 223, and then the transmission member 250 rotates integrally with the driven gear 220.

The transmission member 250 is positioned in the farthest position in which the transmission member 250 is located farthest from the driven gear 220 in the state in which the convex portion and concave portion of the second cam 240 respectively face the concave portion and convex portion of the first cam 230 and positioned in the closest position in which the transmission member is located closest to the driven gear 220 in which the convex portion and concave portion of the second cam 240 respectively face the convex portion and concave portion of the first cam 230.

Therefore, the transmission member 250, when a difference in speed is generated between the first cam 230 and the second cam 240, moves between the farthest position and the closest position since a slip occurs on the cam surfaces of the first cam 230 and the second cam 240 that contact each other. It is to be noted that the engaging portion 252 is fitted into the second hole portion 223 in a position between the farthest position and the closest position of the transmission member 250, and the transmission member 250, even if being in any position, rotates integrally with the driven gear 220.

While the transmission member 250 moves from the farthest position toward the closest position, the projection 253 of the locking portion 251 is displaced radially by the elastic deformation of the locking portion 251 and fits into the first hole portion 222. When the transmission member 250 reaches the closest position, the projection 253 contacts the peripheral edge portion of the outside of the first hole portion 222 by the elastic force of the locking portion 251. The projection 253 that has penetrated the first hole portion 222 is elastically engaged with the peripheral edge portion of the first hole portion 222, which restricts the transmission member 250 from moving to the farthest position.

The biasing member 270 may bias the transmission member 250 toward the stirring shaft 210. Although the biasing member 270 is not limited in particular, a coil spring is used in the present preferred embodiment.

As illustrated in FIG. 4A and FIG. 4B, in the cover 290, the flag member 280 is supported to be capable of moving between a retracting position in the cover 290 and an exposing position exposed from the cover 290, in the radial direction of the driven gear 220.

The coupling member 310 converts the movement in the axial direction of the transmission member 250 into radial movement and transmits the radial movement to the flag member 280.

The sensor 260 may be a photosensor as an example, may optically detect the flag member 280 in the exposed position, and may preferably output a detection signal indicating a full state.

In the state in which, with the biasing force of the biasing member 270, there is little storage amount of waste toner in the waste toner container 300, and the stirring shaft 210 is able to rotate freely, as illustrated in FIG. 4A, the transmission member 250 is positioned in the farthest position, the rotation of the driven gear 220 is transmitted to the stirring shaft 210 through the transmission member 250, and the stirring shaft 210 rotates at a constant speed together with the driven gear 220. At this time, the convex portion and concave portion of the second cam 240 respectively face the concave portion and convex portion of the first cam 230.

When the load (torque) that acts on the rotation of the stirring shaft 210 increases and causes a difference in rotation between the stirring shaft 210 and the driven gear 220 as the storage amount of the waste toner in the waste toner container 300 increases, a slip occurs between the second cam 240 that rotates integrally with the driven gear 220 and the first cam 230 that rotates integrally with the stirring shaft 210.

When the slip occurs between the first cam 230 and the second cam 240, the convex portion and concave portion of the second cam 240 are respectively spaced away from the concave portion and convex portion of the first cam 230 in the circumferential direction, and the transmission member 250 moves toward the closest position against the biasing force of the biasing member 270.

Subsequently, a description will be given of an operation of the waste toner detection mechanism 200 with reference to FIG. 4A and FIG. 4B. It is to be noted that FIG. 4A and FIG. 4B illustrate main characteristic components of the present invention and omit the engaging portion 252 provided in the transmission part 250.

As the stirring shaft 210 of the waste toner detection mechanism 200 rotates, the stirring member 211 contacts the waste toner stored in the waste toner container 300 and planarizes the surface of the waste toner. Therefore, the magnitude of the rotation torque of the stirring shaft 210 is related to the stored amount of the waste toner in the waste toner container 300. When the stored amount of the waste toner in the waste toner container 300 is small, the rotation of the stirring member 211 is not blocked by the waste toner in contact with the stirring member 211 and the stirring shaft 210 rotates smoothly.

At this time, as illustrated in FIG. 4A, the transmission member 250 is positioned in the farthest position, and the coupling member 310 causes the flag member 280 to be positioned in the retracting position in the cover 290. Therefore, the sensor 260 does not detect the flag member 280 and does not output the detection signal indicating a full state.

When the waste toner in the waste toner container 300 approaches a full state, the amount of the waste toner that the stirring member 211 contacts increases and thus the rotation of the stirring member 211 is blocked by the waste toner. Then, as the stirring member 211 pushes aside the waste toner, the rotation torque of the stirring shaft 210 becomes larger gradually and the load applied to the first cam 230 also becomes larger. Therefore, the rotation of the first cam 230 becomes slower gradually with respect to the rotation of the second cam 240 and then a slip occurs.

Accordingly, when the waste toner container 300 becomes full, the stirring member 211 is blocked by the waste toner, the rotation torque therefore becomes the maximum, and the rotation of the stirring shaft 210 is stopped. At this time, as illustrated in FIG. 4B, the transmission member 250 reaches the closest position and the coupling member 310 causes the flag member 280 to be positioned in the exposed position outside of the cover 290. Accordingly, the sensor 260 may preferably detect the flag member 280 and outputs the detection signal indicating a full state.

As illustrated in FIG. 4B, when the transmission member 250 reaches the closest position, the projection 253 is engaged with the outer edge portion of the outside of the first hole portion 222 and restricts the transmission member 250 from moving in the direction to the stirring shaft 210. While the coupling member 310 continuously causes the flag member 280 to be positioned in the exposed position, the sensor 260 continuously outputs the detection signal indicating a full state. It is to be noted that the detection signal outputted by the sensor 260 is transmitted to the image forming apparatus 100.

Based on the detection signal transmitted from the sensor 260, the image forming apparatus 100 is able to be configured such that a notice may be sent to a service center from the control portion of the image forming apparatus 100.

With such a configuration, even if a serviceman does not visit a user and does not replace containers, a new container is able to be automatically delivered to the user.

In addition, as described above, the waste toner detection mechanism 200 according to the present invention may be provided with the sensor 260. Therefore, once a full state has been detected, even when, for example, the image forming apparatus 100 is not used for a while, the waste toner that has been stored in full sinks by self-weight in the waste toner container 300, and, in appearance, the waste toner is able to be added and stored in the waste toner container 300, this waste toner container 300 is no longer able to collect waste toner. Thus, the full state is able to be detected with high accuracy.

In addition, when the cover 290 is removed, the projection 253 of the locking portion 251 that is elastically engaged with the outer edge portion of the first hole portion 222 of the driven gear 220 is able to be easily accessed, and a serviceman can easily release the engagement of the locking portion 251 with respect to the outer edge portion of the first hole portion 222 using a tool. Therefore, the waste toner is discarded from the waste toner container 300 of a full state, and the waste toner container 300 is able to be reused.

Second Preferred Embodiment

As a second preferred embodiment, either one of the first cam 230 and the second cam 240 may be configured by a projection that contacts the inclined surface of the other cam.

Third Preferred Embodiment

As a third preferred embodiment, the color of the driven gear 220 may be able to be made different from the color of the locking portion 251 or the engaging portion 252. With this configuration, since the locking portion 251 is able to be recognized easily, a recovery operation of reuse of the waste toner container 300 is able to be performed efficiently.

The foregoing preferred embodiments are illustrative in all points and should not be construed to limit the present invention. The scope of the present invention is defined not by the foregoing preferred embodiment but by the following claims. Further, the scope of the present invention is intended to include all modifications within the scopes of the claims and within the meanings and scopes of equivalents.

What is claimed is:

1. A waste toner detection mechanism provided in a waste toner container provided with a rotation transmission member and a stirring shaft to which rotation is transmitted through the rotation transmission member, the waste toner detection mechanism comprising:

a transmission member that transmits the rotation of the rotation transmission member to the stirring shaft, the transmission member being capable of moving between a farthest position in which the transmission member is located farthest from the rotation transmission member in an axial direction of the stirring shaft and a closest position in which the transmission member is located closest to the rotation transmission member in the axial direction of the stirring shaft, and the transmission member moving from the farthest position to the closest position with an increase in difference in rotation between the rotation transmission member and the stirring shaft; and a flag member that moves from a retracted position in which the flag member is stored in the waste toner container to an exposing position in which the flag member is exposed from the waste toner container along with the transmission member moving from the farthest position to the closest position; wherein the transmission member comprises a locking portion that is elastically engaged with the rotation transmission member in the closest position and restricts the transmission member from moving to the farthest position.

2. The waste toner detection mechanism according to claim 1, wherein the transmission member further comprises:

an engaging portion that is engaged with the rotation transmission member on the surface of the rotation transmission member; and a cam portion that causes the transmission member to move from the farthest position to the closest position with the increase in difference in rotation while transmitting rotation to the stirring shaft.

3. The waste toner detection mechanism according to claim 2, wherein the cam portion comprises:

an inclined cam that is formed so as to protrude from at least one of an end portion of the stirring shaft on a side of the transmission member and a surface of the transmission member on a side of the stirring shaft, along a circumferential direction; and a cam follower that is formed so as to protrude and contact an inclined surface of the inclined cam.

4. The waste toner detection mechanism according to claim 1, further comprising a biasing member that biases the transmission member in a direction of the stirring shaft.

5. The waste toner detection mechanism according to claim 1, further comprising a sensor that outputs a detection signal when the flag member is located in the exposed position.

6. An image forming apparatus comprising:

the waste toner detection mechanism according to claim 1;

an image forming portion that performs electrophotographic image formation; and a waste toner container that stores waste toner that has been collected from the image forming portion.

* * * * *